US006131526A

United States Patent [19]

Iida et al.

[11] Patent Number: 6,131,526

[45] Date of Patent: Oct. 17, 2000

[54] EMBROIDERY DATA PROCESSING DEVICE

[75] Inventors: Yuji Iida; Shintaro Tomita, both of Nagoya, Japan

[73] Assignee: Brother Kogyo Kabushiki Kaisha, Nagoya, Japan

[21] Appl. No.: 09/347,527

[22] Filed: Jul. 6, 1999

[30] Foreign Application Priority Data

Jul. 10, 1998 [JP] Japan ..... 10-195827

[51] Int. Cl.[7] ..... D05B 21/00; D05C 5/02

[52] U.S. Cl. ..... 112/102.5; 112/445; 112/470.04; 112/475.19; 700/138

[58] Field of Search ..... 112/102.5, 470.04, 112/470.06, 456, 458, 445, 475.19; 700/138

[56] References Cited

U.S. PATENT DOCUMENTS 5,784,986 7/1998 Morita ..... 112/102.5

5,791,270 8/1998 Mori ..... 112/102.5

5,855,176 1/1999 Takenoya et al. ..... 112/102.5

*Primary Examiner*—Peter Nerbun

*Attorney, Agent, or Firm*—Oliff & Berridge, PLC

[57] ABSTRACT

When rotating processing of an embroidery pattern is called, an embroidery data processing device first determines whether a right turn key is operated. When the right turn key is operated, a current rotational angle is increased by a predetermined number of degrees. By contrast, when a left turn key is operated, the current rotational angle is reduced by a predetermined number of degrees. Further, display of a mask indicating sizes in the X and Y directions of the embroidery pattern is changed based on the instructed rotational angle. When the rotational angle is finally determined, the embroidery pattern is rotationally converted and the mask data is formed based on the embroidery data after the conversion. Therefore, when the embroidery pattern is rotated, a range for arranging the rotated embroidery pattern in a sewing area is not narrowed.

20 Claims, 13 Drawing Sheets

Fig.11

| ADDRESS | |
|---|---|
| | TOP ADDRESS OF 1-ST PATTERN |
| | TOP ADDRESS OF 2-ND PATTERN |
| | |
| | |
| | TOP ADDRESS OF N-TH PATTERN |
| | |
| FIRST PATTERN TOP ADDRESS | MASK DATA OF 0 DEGREE x |
| | MASK DATA OF 0 DEGREE y |
| | MASK DATA OF 5 DEGREE x |
| | MASK DATA OF 5 DEGREE y |
| | |
| | |
| | MASK DATA OF 355 DEGREE x |
| | MASK DATA OF 355 DEGREE y |
| | SEWING DATA OF 1-ST STITCH X |
| | SEWING DATA OF 1-ST STITCH Y |
| | SEWING DATA OF 2-ND STITCH X |
| | SEWING DATA OF 2-ND STITCH y |
| | |
| | |
| | SEWING DATA OF N-TH STITCH X |
| | SEWING DATA OF N-TH STITCH Y |
| SECOND PATTERN TOP ADDRESS | MASK DATA OF 0 DEGREE X |
| | MASK DATA OF 0 DEGREE y |
| | MASK DATA OF 5 DEGREE x |
| | MASK DATA OF 5 DEGREE y |
| | |
| | |
| | MASK DATA OF 355 DEGREE x |
| | MASK DATA OF 355 DEGREE y |
| | SEWING DATA OF 1-ST STITCH X |
| | SEWING DATA OF 1-ST STITCH Y |
| | SEWING DATA OF 2-ND STITCH X |
| | SEWING DATA OF 2-ND STITCH Y |
| | |
| | |
| | SEWING DATA OF N-TH STITCH X |
| | SEWING DATA OF N-TH STITCH Y |

EMBROIDERY DATA PROCESSING DEVICE

BACKGROUND OF THE INVENTION

1. Field of Invention

The invention relates to an embroidery data processing device for processing embroidery data for forming embroidery and a storage medium storing an embroidery data processing program in a sewing apparatus of any sewing machine ranging from industrial sewing machines to sewing machines for household use.

2. Description of Related Art

There is an embroidery sewing machine for, for example, household use that includes many types of embroidery patterns, such as pictures and letters, that are selectably provided and an embroidery pattern selected from them can be formed on work-cloth by a user. According to the above-described sewing machine, embroidery data necessary for executing the embroidery forming operation is stored in a memory, such as a ROM (Read Only Memory), or the like, built into the main body of the sewing machine or an outside ROM card attachably and detachably provided to the sewing machine main body. Further, when the user selects a desired embroidery pattern, embroidery data in correspondence with the embroidery pattern is read from the built-in memory or the outside ROM card.

According to such a sewing machine, when the user selects a desired embroidery pattern, an arrangement and editing screen is displayed on a LCD (Liquid Crystal Display), display device or similar display, provided at, for example, a front face of the sewing machine main body. On the arrangement and editing screen, a layout region showing the sewable region of work-cloth is displayed surrounded by a frame. Further, the selected embroidery pattern is displayed within the layout region in accordance with an image (ratio) for forming the embroidery.

For example, when a pattern of a "dog" is selected, as shown by FIG. 12, the pattern b of the "dog" is displayed at substantially the central portion in the layout region a. Further, the user can arrange and edit the pattern by rotating the pattern or by operating an operating unit while viewing the arrangement and editing screen. In this case, the arrangement and editing processing is carried out based on a mask M having a rectangular frame shape surrounding the pattern b. The mask M is displayed based on mask data comprising a combination of a minimum value of x coordinate and a minimum value of y coordinate and a maximum value of x coordinate and a maximum value of y coordinate, among coordinates of the outer shape of the pattern b. In this way, the size of the mask data is smaller than that of embroidery data and accordingly, the processing of arrangement and edition can swiftly be executed.

Meanwhile, a change in the arrangement of the pattern is feasible only within the layout region a. Therefore, when the arrangement of the pattern is instructed, it is determined whether the pattern after the change is confined in the layout region a. In this case, it can easily be determined by comparing coordinates of the apexes of the four corners of the mask M of the changed arrangement with the coordinates of the apexes of the four corners of the layout region a.

However, when the arrangement of the pattern is changed based on the mask M in this way and the determination of whether the pattern is confined in the layout region a is carried out based on the mask M after the change, the following problem is posed. That is, for example, when the pattern b in the state shown by FIG. 12 is rotated by 45 degrees and thereafter moved downwardly, as shown in FIG. 13, although the pattern b is remote from a lower side of the layout region a by a dimension L, when one apex of the mask M reaches the lower side of the layout region a, further movement is not feasible. That is, there poses a problem in which the range of possible arrangements of the pattern b within the layout region a is narrower than the range that is possible if actually arranging the pattern b. Such a problem is posed when the pattern b is rotated to a rotational angle at which the four sides of the mask M are not in parallel with four sides of the frame indicating the layout region a.

SUMMARY OF THE INVENTION

It is an object of the invention to provide an embroidery data processing device in which, when an embroidery pattern is rotated, the range possible for arranging the rotated embroidery pattern in a sewing area is prevented from being narrowed and a storage medium storing an embroidery data processing program therefor.

According to an aspect of the invention, there is provided an embroidery data processing device for editing embroidery data which is used by a sewing machine having a sewing area having a predetermined size in a rightward/leftward (X) direction and a backward/forward (Y) direction, the embroidery data processing device comprising selecting means for selecting at least one embroidery pattern, displaying means for displaying the embroidery pattern selected by the selecting means within a layout region indicating the sewing area of the sewing machine, the embroidery pattern being arranged freely in the layout region, rotation instructing means for instructing rotation of the embroidery pattern selected by the selecting means, converting means for rotationally converting embroidery data of the selected embroidery pattern based on an instruction of the rotation instructing means, mask data forming means for forming mask data indicating a length of the embroidery pattern in the X direction and a length of the embroidery pattern in the Y direction, determining means for determining whether the embroidery pattern can be arranged within the layout region by using the mask data of the selected embroidery pattern, and regulating means for regulating the arrangement of the embroidery pattern if the determining means determines that the embroidery pattern can not be arranged within the layout region.

According to such a structure, when the embroidery data is rotationally converted by the data converting means based on the instruction of the rotation instructing means, the mask data forming means newly forms the mask data with respect to the rotated embroidery pattern based on the rotationally converted embroidery data. Therefore, even when the embroidery pattern is rotated, the invention avoids narrowing a range in which the rotated embroidery pattern can be arranged.

Further, it is preferable that every time after the converting means rotationally converts the embroidery data, the mask data forming means forms the mask data of the embroidery data converted by the converting means.

According to such a structure, whenever the rotation of the embroidery pattern is executed, the new mask data of the rotated embroidery pattern can be obtained.

Further, it is preferable that when the embroidery pattern is instructed to rotate by every predetermined unit angle by one operation of the rotation instructing means, the mask forming means is structured to form the mask data at every operation by the rotation instructing means.

According to such a structure, the mask data is reformed by the mask data forming means at every operation by the rotation instructing means and, accordingly, the inconvenience in which the embroidery pattern cannot be arranged as desired, although the embroidery pattern is confined to the sewing area, is prevented.

Further, when there is provided finally determining means for finally determining a rotational angle instructed by the rotation instructing means, the mask data forming means may be structured to form the mask data after the rotational angle has been finally determined by the finally determining means.

According to such a structure, the mask data forming means forms the mask at a time when the rotational angle of the embroidery pattern has been finally determined by the finally determining means and accordingly, efficiency is excellent.

Further, there may be further provided rotation instructing means for instructing the rotation of the embroidery pattern selected by the selecting means by every predetermined unit angle, rotated pattern mask data forming means for forming the mask data in respect of all of rotated patterns provided by rotating the embroidery pattern by the every unit angle when the embroidery pattern is selected by the selecting means and data converting means for rotationally converting the embroidery data of the embroidery pattern selected by the selecting means based on an instruction of the rotation instructing means.

According to such a structure, when the embroidery pattern is selected by the selecting means, the rotated pattern mask data forming means has formed therein the mask data of all possible rotated patterns and, accordingly, when rotation of the embroidery pattern is instructed by the rotation instructing means, the time and labor for forming the mask data of the rotated pattern can be dispensed with.

Further, there may be further provided mask data storing means for storing the mask data in correspondence with all of the rotated patterns provided by rotating the embroidery pattern by every unit angle and data converting means for converting embroidery data of the embroidery pattern selected by the selecting means based on an instruction by the rotation instructing means.

According to such a structure, the mask data in correspondence with all of the rotated patterns is previously stored in the mask data storing means and, accordingly, time and labor for forming the mask data of the rotated pattern is dispensed with.

In addition thereto, there may also be provided display data forming means for forming display data based on the embroidery data converted by the converting means.

According to such a structure, display data is formed based on the converted embroidery data by the display data forming means and, accordingly, the accuracy of the display data is promoted and the rotated embroidery pattern can accurately be displayed in the displaying means.

Further, there may also be provided mask size displaying means for displaying the mask data of the embroidery pattern rotation of which is instructed by the rotation instructing means.

According to such a structure, the sizes of the rotated embroidery pattern can be confirmed and accordingly, the convenience of use is improved.

Further, according to another aspect of the invention, there is provided a computer readable storage medium for storing a computer program providing a method for editing embroidery data, the embroidery data being used by a sewing machine having a sewing area having a predetermined size in a rightward/leftward (X) direction and a backward/forward (Y) direction, the method comprising the steps of selecting at least one embroidery pattern, displaying the selected embroidery pattern within a layout region indicating the sewing area of the sewing machine, the embroidery pattern being arranged freely in the layout region, instructing rotation of the selected embroidery pattern, rotationally converting embroidery data of the selected embroidery pattern, forming mask data indicating a length of the embroidery pattern in the X direction and a length of the embroidery pattern in the Y direction, determining whether the embroidery pattern can be arranged within the layout region by using the mask data of the selected embroidery pattern, and regulating the arrangement of the embroidery pattern if it is determined that the embroidery pattern can not be arranged within the layout region.

By executing the embroidery data processing program by reading the storage medium having the above-described structure by a computer, the embroidery data is converted based on the instruction of the rotation instructing means and the mask data with respect to the rotated embroidery pattern is formed based on the converted embroidery data. Accordingly, even when the converted embroidery pattern is rotated, the inconvenience in which a range capable of arranging the rotated embroidery pattern in the sewing area is narrowed is avoided.

BRIEF DESCRIPTION OF THE DRAWINGS

The invention will be described in greater detail with reference to preferred embodiments thereof and the accompanying drawings, wherein;

FIG. 11 shows a second embodiment of the invention and is a diagram indicating a memory map structure of the ROM;

DETAILED DESCRIPTION OF PREFERRED EMBODIMENTS

An explanation will be given of a first embodiment in which the invention is applied to an embroidery sewing machine for household use with reference to FIG. 1 through FIG. 10 as follows. According to the embodiment, the sewing machine is also provided with the function of a sewing data processing device.

Figure 3:
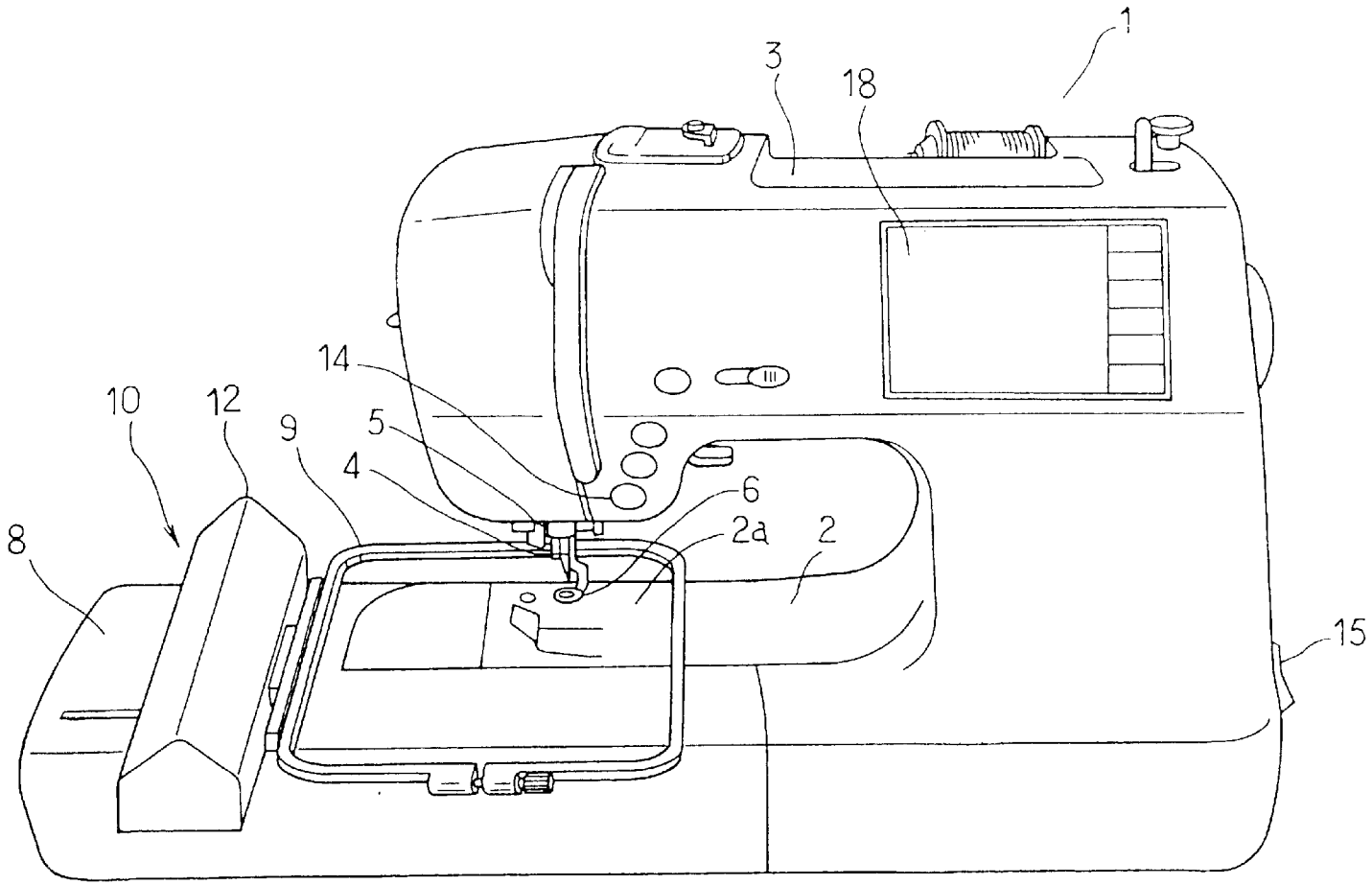
FIG. 3 is a perspective view of an embroidery sewing machine.

First, FIG. 3 shows the sewing machine. The machine main body 1 is structured to be integrally provided with an arm portion 3 extending above a machine bed 2. A front end portion (to the left in FIG. 3) of the arm portion 3 has a needle bar 5 mounting a sewing needle 4 and a presser foot 6 in the shape of a ring through which the sewing needle 4 passes. The presser foot 6 holds, and surrounds, the work-cloth (not illustrated) through which the sewing needle 4 passes with an appropriate force.

Meanwhile, at an upper face portion of the machine bed 2, a throat plate 2*a* is installed in correspondence with the needle bar 5. Further, in the machine bed 2, a shuttle mechanism (not illustrated) is arranged below the throat plate 2*a*. Although a detailed explanation is omitted, the needle bar 5 and the shuttle mechanism are structured to be driven in synchronism with each other by a machine motor 7 (illustrated only in FIG. 4) via a drive mechanism.

Further, an embroidery unit 8 is attachably and detachably mounted to a left end portion (as seen in FIG. 3 and from a user's perspective) of the machine bed 2. The embroidery unit 8 is provided with an embroidery frame 9 for holding the work-cloth and an embroidery frame moving mechanism 10 for moving the embroidery frame 9 in the horizontal direction (X-axis direction and Y-axis direction). The embroidery frame has an outer frame and an inner frame to pinch the work-cloth therebetween. So mounted, the work-cloth is stretched across the lower portion of the embroidery frame 9 along an upper face of the throat plate 2*a*.

Figure 4:
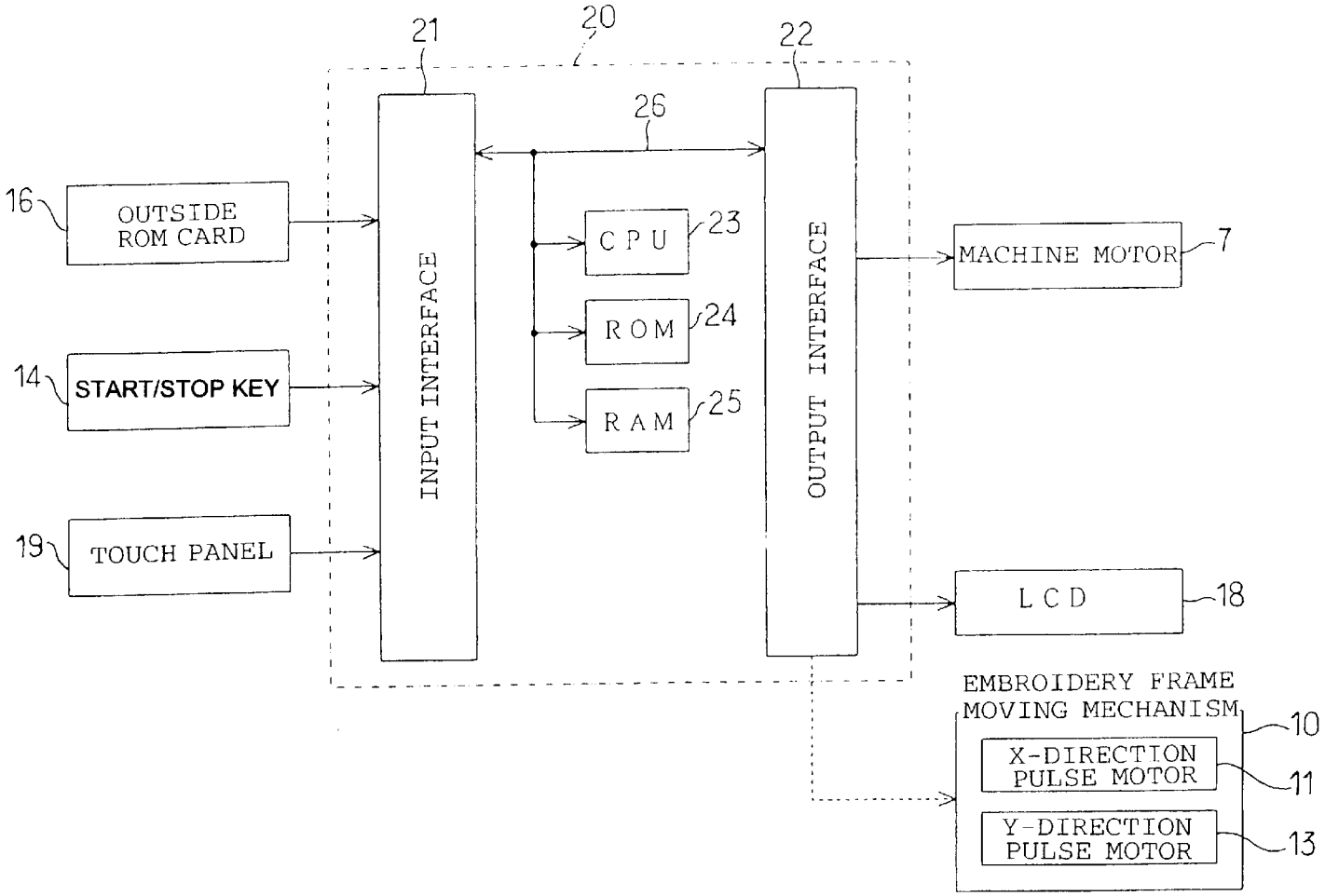
FIG. 4 is a block diagram of the electrical structure of the embroidery sewing machine.

The embroidery frame moving mechanism 10 is provided with a moving member 12 movable in the X-axis direction (left and right direction) by an X-direction pulse motor 11 (illustrated only in FIG. 4). The moving member 12 is attached such that the embroidery frame 9 is movable in the Y-axis direction (front and rear direction) by a Y-direction pulse motor 13 (illustrated only in FIG. 4).

In this way, the work-cloth held by the embroidery frame 9 can be moved to a position based on an inherent XY coordinate system by the embroidery frame moving mechanism 10. Further, by freely moving the work-cloth using the embroidery frame moving mechanism 10 and driving the needle bar 5, with needle 4, and the shuttle mechanism by the drive machine motor 7 the embroidery forming operation is executed.

Further, the embroidery sewing machine according to the embodiment is able to execute various kinds of practical sewing operations (such as straight line sewing, zigzag sewing and running stitch) other than the above-described embroidery forming operation. Further, when the practical sewing operations are carried out, a flat table (not illustrated) is attachably and detachably mounted to the machine bed 2 in place of the embroidery unit 8. In this case, the work-cloth is fed in the forward and rearward direction, the sewing needle 4 is withdrawn from the work-cloth, by a feed dog (not illustrated) arranged below the throat plate 2*a*. Further, although a detailed explanation will be omitted, the needle bar 5 (sewing needle 4) can be oscillated for displacement in the left and right direction by a needle oscillating mechanism, not illustrated, allowing zigzag and other such sewing to be carried out.

Further, as shown by FIG. 3, the front face of the front end portion of the arm portion 3 has various keys, to include a start/stop key 14. A power supply switch 15 is provided at a lower portion of a right side face portion of the machine main body 1. Further, the right side face portion of the machine main body 1 also has a card insertion slot (not illustrated) into which ROM card 16 (illustrated only in FIG. 4) can be inserted.

The front face portion of the arm portion 3 has a display device, constituting the displaying means, for displaying various kinds of screens for actions, such as selection, arrangement, and editing of an embroidery pattern. As shown, the display device is a liquid crystal display (LCD) 18. The surface of LCD 18 is provided with a touch panel 19 (illustrated only in FIG. 4) that provides various operation keys. As is well known, the touch panel 19 arranges transparent electrodes in the vertical and horizontal directions. FIG. 4 is a diagram showing the electrical structure of the sewing machine according to the embodiment using function blocks. In FIG. 4, a control apparatus 20 is comprised, for example, mainly of a microcomputer comprising an input interface 21, an output interface 22, a CPU (Central Processing Unit) 23, a ROM 24 and a RAM (Random Access Memory) 25 connected to one another by a bus line 26.

ROM 24, mentioned above, stores control programs for controlling the embroidery forming operation and the practical sewing operation of the machine main body 1, a control program for display control of LCD 18, a data processing program for carrying out various types of data processing, such as editing and other appropriate programs. Further, ROM 24 stores pattern data for a large number of embroidery patterns. As examples for this description, the embroidery patterns are picture patterns and ornamental patterns having comparatively simple shapes, Japanese syllabary, alphabet, numerals, and signs. The foregoing is not limiting as the stored patterns can be very elaborate. Further, the outside ROM card 16 stores pattern data for comparatively complicated picture patterns and for a large number of embroidery patterns. Accordingly, ROM 24 and the outside ROM card 16 correspond to storing means.

According to the embodiment, the pattern data includes embroidery data necessary for the embroidery forming operation, display data (bit map data) necessary for displaying various pattern shapes on LCD 18 and mask data indicating sizes (length dimensions) of embroidery patterns in the rightward/leftward direction (hereinafter X direction) and the backward/forward direction (hereinafter Y direction). In this case, embroidery data stored in ROM 24 comprises data indicating coordinates of an outer shape of a pattern and is such that data indicating the amount of movement (stitch positions) in the X-direction and Y-direction of the work-cloth at each stitch is formed by calculation. Further, the above-described mask data comprises data comprising minimum values of x and y coordinates and maximum values of x and y coordinates among coordinates of the outer shape of an embroidery pattern. It is also possible that embroidery data and display data are commonly provided or only one of the data is stored and other data is formed by the one data. Further, the mask data can also be formed by the embroidery data.

Further, the output interface 22 is connected with the machine motor 7, the X-direction pulse motor 11 and the Y-direction pulse motor 13 of the embroidery frame moving mechanism 10 and LCD 18. The input interface 21 is connected with the touch panel 19 and the start/stop key 14. Further, when the outside ROM card 16 is inserted into the card insertion slot 17, the input interface 19 is electrically connected to the outside ROM card 16.

As mentioned later, according to the above-described structure, the control device 20 and the touch panel 19 correspond to selecting means, rotation instructing means and final determining means, the control device 20 corresponds to data converting means, mask data forming means and display data forming means and LCD 18 corresponds to displaying means and mask size displaying means.

Figure 1:
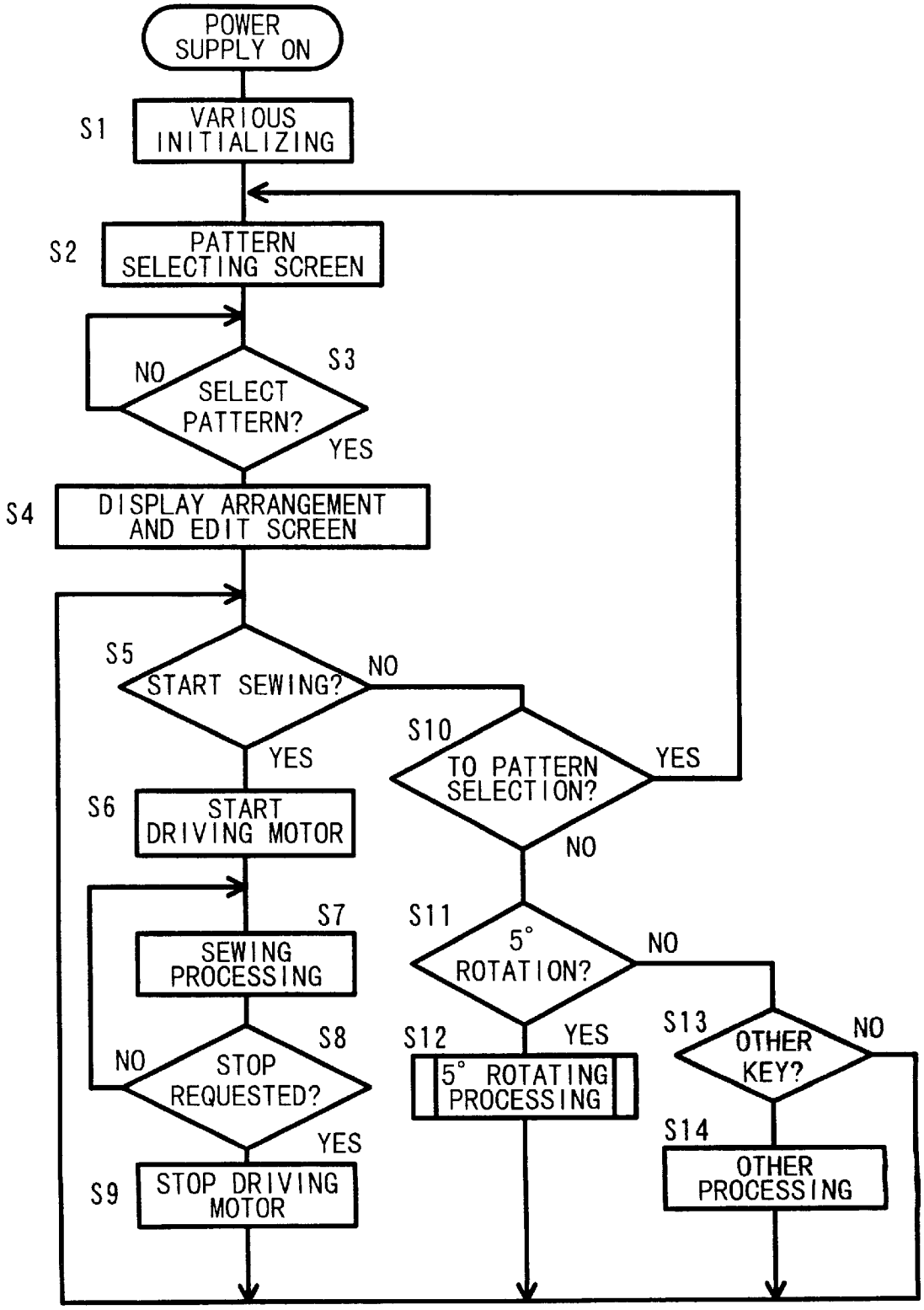
FIG. 1 shows a first embodiment according to the invention and is a flowchart of the operation from embroidery data processing through sewing.
Figure 2:
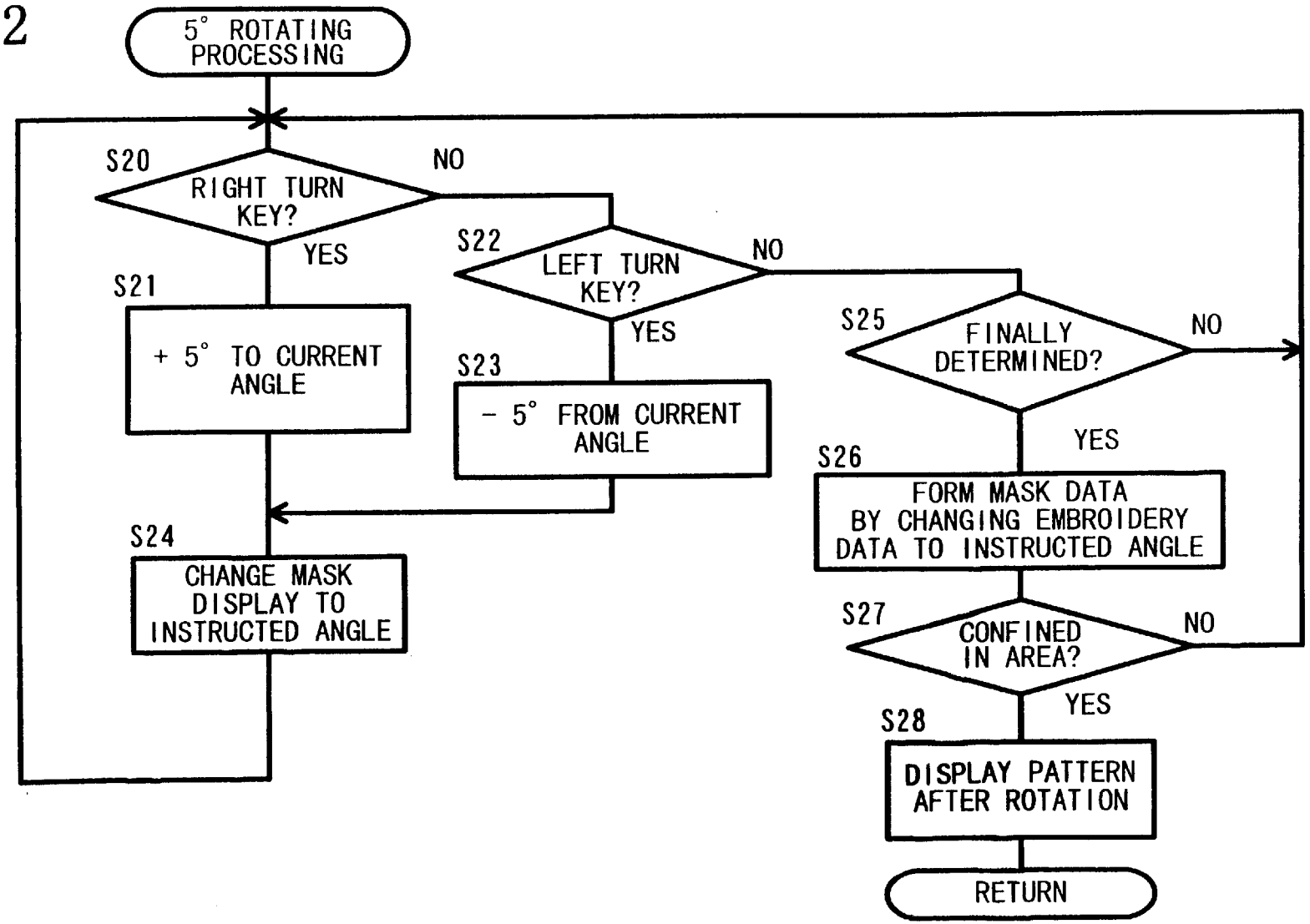
FIG. 2 is a flowchart of rotating processing.
Figure 5:
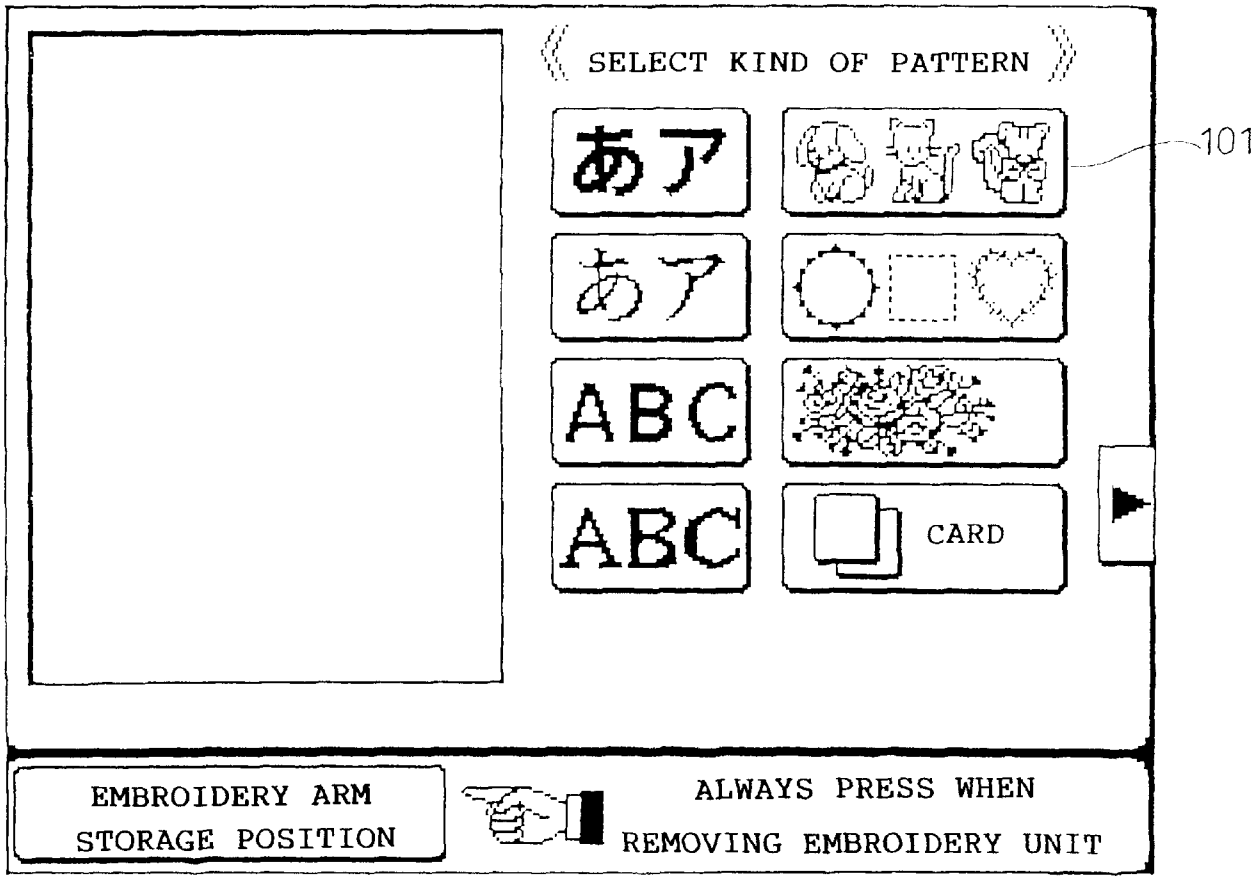
FIG. 5 is a view of an example of an pattern type selecting screen displayed on a liquid crystal screen (LCD)
Figure 6:
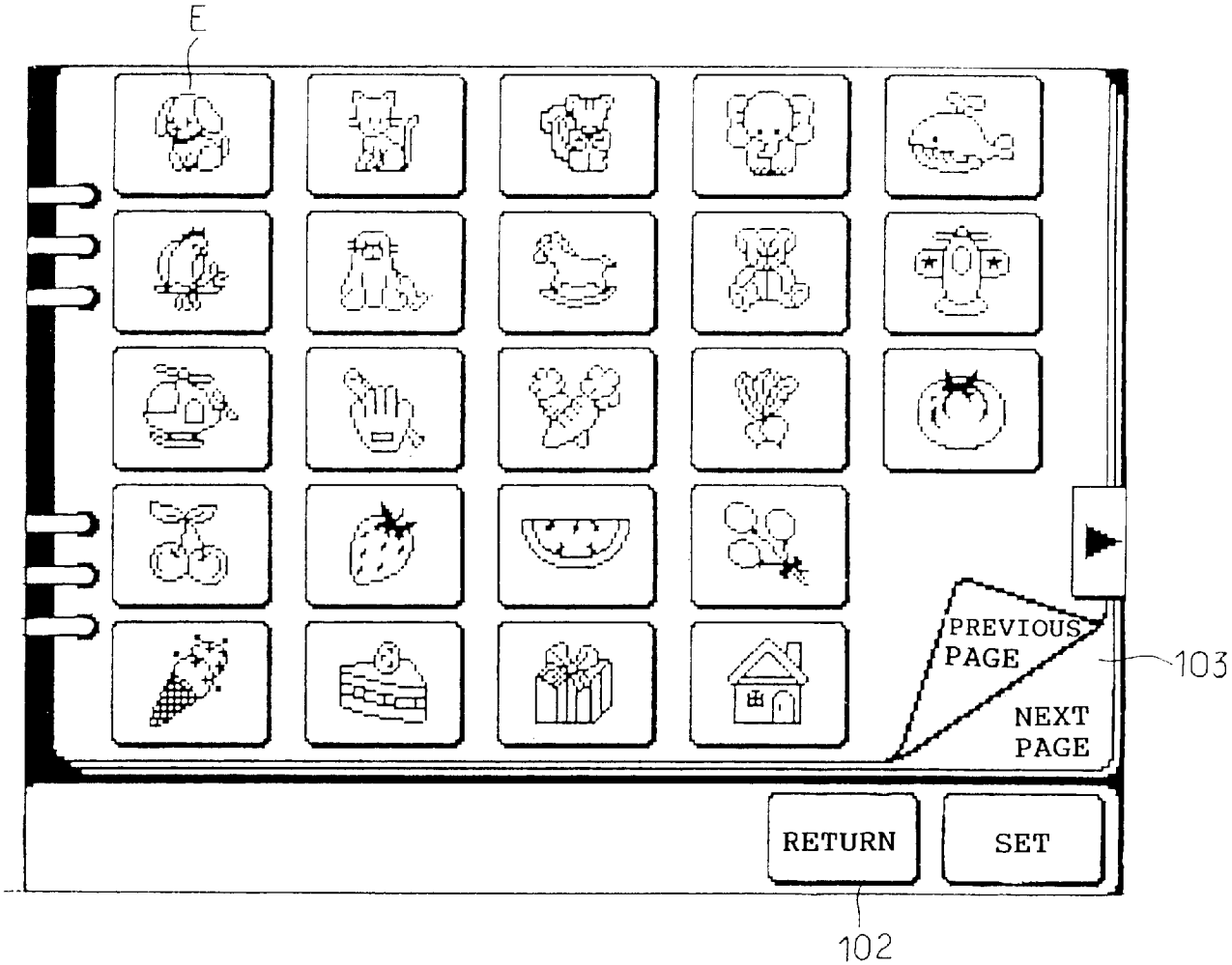
FIG. 6 shows an example of a pattern selecting screen displayed on the LCD.

Next, an explanation will be given of the operation of the control device 20 according to the embodiment with reference to FIGS. 1 and 2. FIG. 1 is a flowchart showing the operation of embroidery data processing through sewing and FIG. 2 is a flowchart showing rotating processing for an embroidery pattern. Further, in the following processings, an explanation will be given with examples of screen displays shown by FIGS. 5 through 10. FIG. 5 shows an example of a pattern kind, or type, selecting screen displayed on LCD 18 and FIG. 6 shows an example of a pattern selecting screen displayed on LCD 18. Further, FIGS. 7 through 10 each show an example of an arrangement and editing screen displayed on LCD 18.

First, when the power supply switch 15 of the machine main body 1 is turned ON, a pattern kind selecting screen, shown in FIG. 5, is displayed on LCD 18 (step S1). The pattern kind selecting screen is displayed with the kinds or gross classifications of patterns in which a number of embroidery patterns are placed. There are eight kinds of patterns for this purpose. Next, when one pattern kind is selected from the pattern kind selecting screen, a pattern selecting screen for the kind of the pattern is displayed on LCD 18 (step S2).

In this case, assume that a pattern kind 101 is selected from the pattern kind selecting screen. When the pattern kind 101 is selected, as shown by FIG. 6, the screen of LCD 18 is switched to a pattern selecting screen for selection from picture patterns of "dog", "cat", "squirrel" and so on. In this case, when the "return" (return key 102) is pushed, the current screen is returned to the pattern kind selecting screen (FIG. 5).

The user selects a pattern which the user desires formed by embroidery by viewing the pattern selecting screens (step S3). The selection is carried out by a finger touch operation on a portion displaying the pattern the user wishes to select on the screen (touch panel 19) of LCD 18. The pattern selecting screens for picture patterns of a kind may be presented on a plurality of pages. When the desired pattern is not present on a page which is being currently displayed, the user switches the current page to another pattern selecting screen by touch operation of the "Previous page" or "Next page" designators on the LCD 18 (page feed key 103).

In this case, assume that a pattern E of "dog" is selected from the pattern selecting screen shown by FIG. 6. When the pattern E is selected (YES at step S3), pattern data with respect of the pattern E is read from ROM 24 or the outside ROM card 16 and is written to RAM 25. An arrangement and editing screen, shown by FIG. 7, is then displayed on LCD 18 (step S4).

The arrangement and editing screen displays a layout region A representing a sewing area of the sewing machine surrounded by a frame in substantially a left half portion of the screen and an image of the selected pattern E is displayed substantially at a central portion of the layout region A. The image display is displayed based on display data of the pattern E. Further, in the arrangement and editing screen, there are displayed various keys indicating operations obtained using the touch panel 19, specifically, moving keys 104, an erasing or deleting key 105, a pattern designating key 106, a rotating key 107, a left/right reversing key 108 and a completion key 109.

The moving keys 104 are keys for moving the pattern E in the directions of the arrow marks or toward the center. The left/right reversing key 108 is a key for reversing the left and the right of the pattern E. The erasing key 105 is a key for returning an edited pattern to the state before editing. The pattern designating key 106 is used to designate a pattern as an object for editing. The completion key 109 is used to finish the arranging and editing processing. A detailed description will be given below of the rotating key 107.

Figure 7:
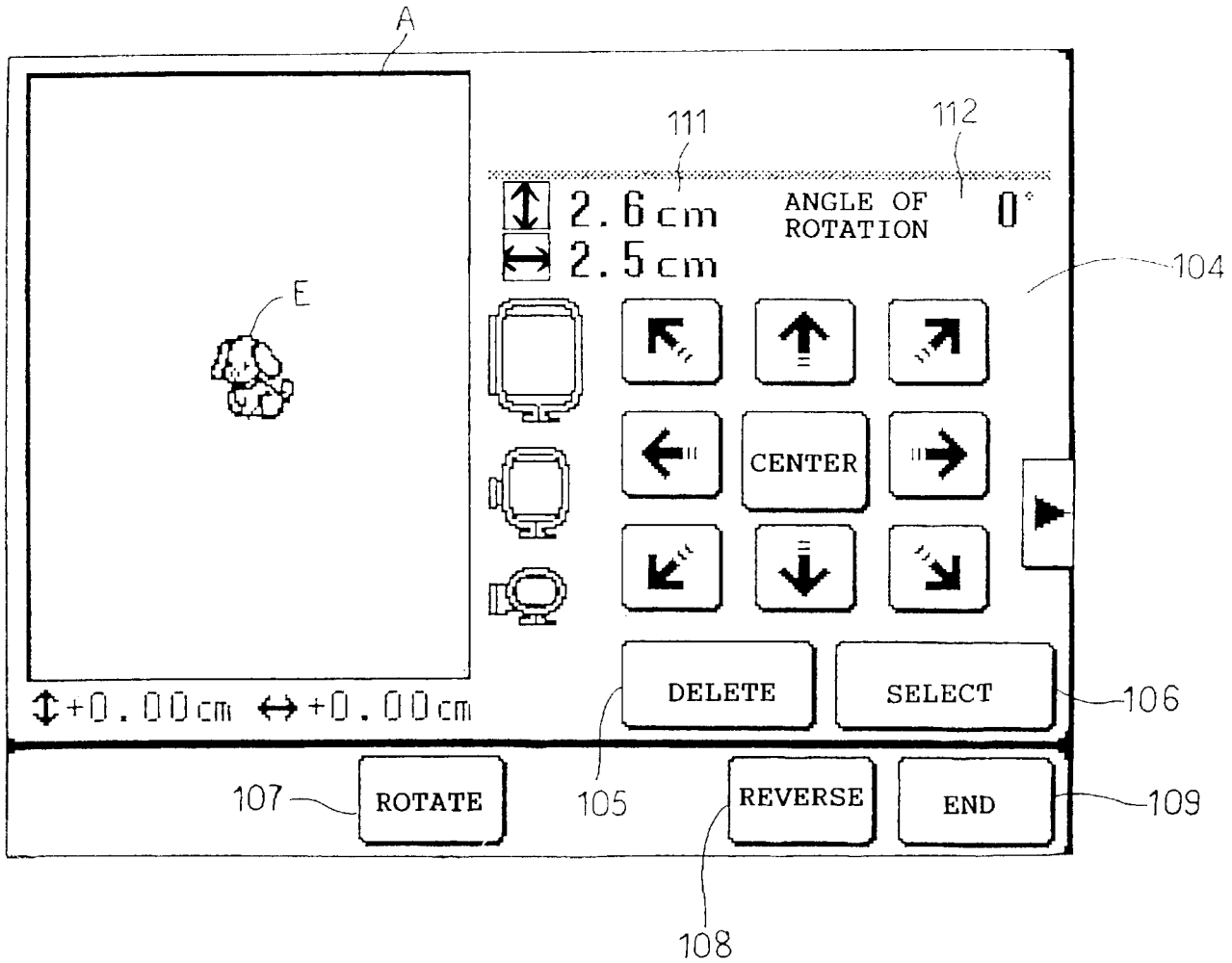
FIG. 7 shows an example of an arrangement and editing screen displayed on the LCD.

Further, the key arrangement shown by FIG. 7 is only an example. For example, there can be a key for magnifying or reducing the embroidery pattern, a key for changing the arrangement of the embroidery pattern, a key for changing an interval between contiguous embroidery patterns and for any other functionalities appropriate to the sewing machine.

Further, according to the arrangement and editing screen, a mask size display 111 and an angle display 112 are positioned at an upper portion on the right side of the layout region A. The mask size display 111 provides the length dimensions in the X and Y directions of the selected pattern.

In this case, the length dimensions in the X and Y directions of the pattern designate length directions relative to dimensions in the X and Y directions of the layout region A and are changed as necessary by rotating the pattern. In the case of the pattern E as shown in FIG. 7, the length direction from the head to the feet of "dog" is the dimension in the Y direction. When pattern E is rotated by 90 degrees, the length direction from the head to the feet of "dog" would constitute the dimension in the X direction. The length dimensions in the X and Y directions of a pattern are provided by calculating mask data of the pattern E.

Further, a rotational angle θ of the selected pattern E is displayed in the angle display 112. According to the embodiment, the rotational angle θ of the pattern displayed within the layout region A is set to 0 degree based on pattern data stored in ROM 24 or the outside ROM card 16. Accordingly, as shown in FIG. 7, after selecting the pattern E, before rotating the pattern, "0°" is displayed in the angle display 12 of the arrangement and editing screen.

When the operator intends to execute the embroidery forming operation without changing the arrangement and/or attitude of the pattern by viewing the arrangement and editing screen, the operator finishes the arrangement and edition processing by pressing the completion key 109 and start sewing by pushing the start/stop key 14 (YES at step S5). Thereby, the embroidery forming operation is executed by driving the machine motor 7, needle bar 5 with needle 4 and shuttle mechanism and feed plate on the basis of the embroidery data written to RAM 25, mentioned above (steps S6 through S9).

Further, when another pattern is selected (NO at step S5, YES at step S10), the operation returns again to the pattern selecting screen at step S2 and selects a desired pattern by the above-described procedure.

Figure 8:
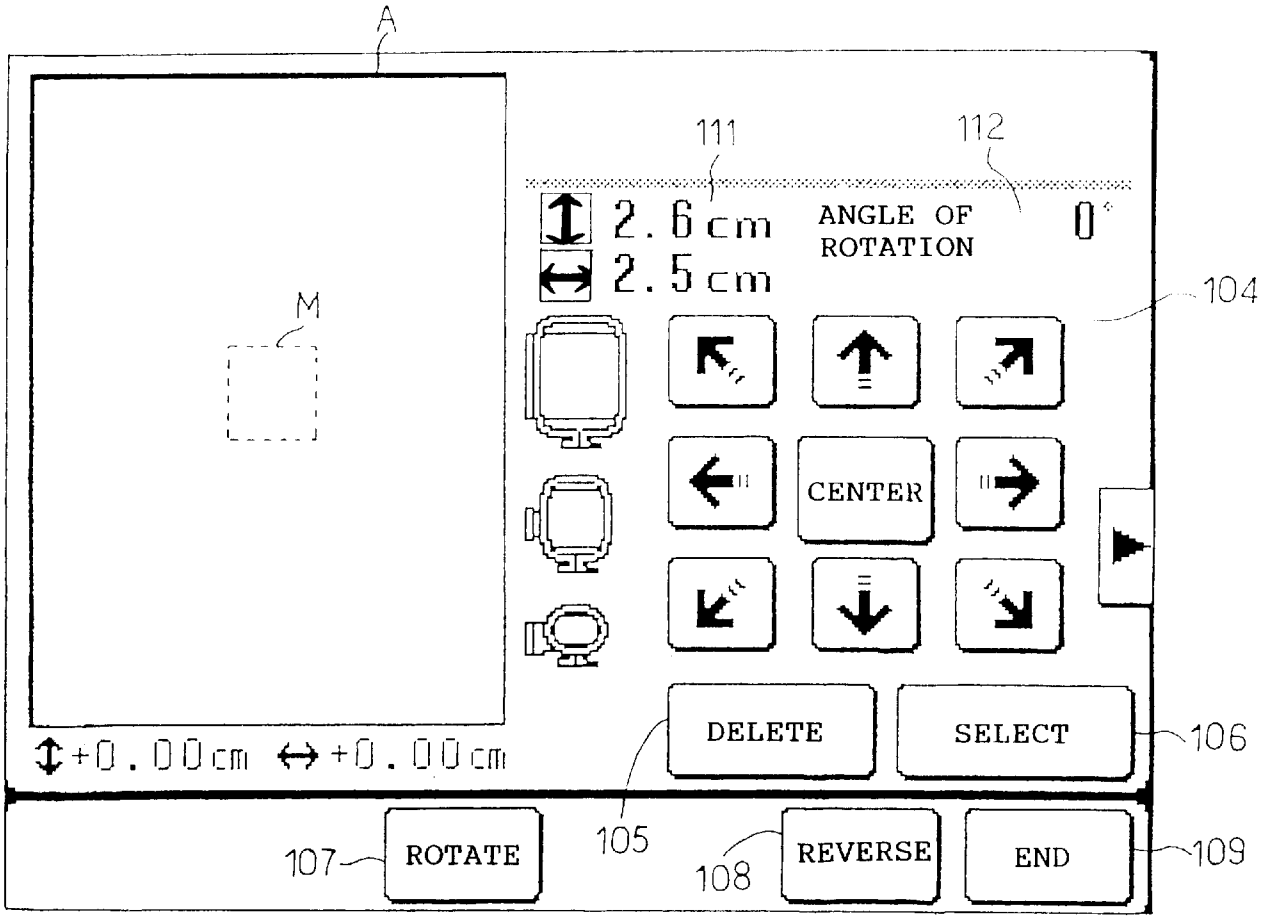
FIG. 8 shows an example of an arrangement and editing screen displayed on the LCD.

In contrast thereto, when the arrangement and editing processing of the pattern is carried out (NO at step S10), it is carried out on the currently designated pattern. Then, as shown by FIG. 8, in the layout region A, in place of the designated pattern (here, pattern E), a mask M in correspondence with the pattern E is displayed based on the mask data.

Successively, at step S11, whether the rotating key 107 is operated is determined. When the rotating key 107 is not operated (NO at step S11), whether a key instructing other processing is pushed is determined (step S13), when the touch operation is carried out (YES at step S13), a processing instructed by the key is carried out (step S14).

Figure 9:
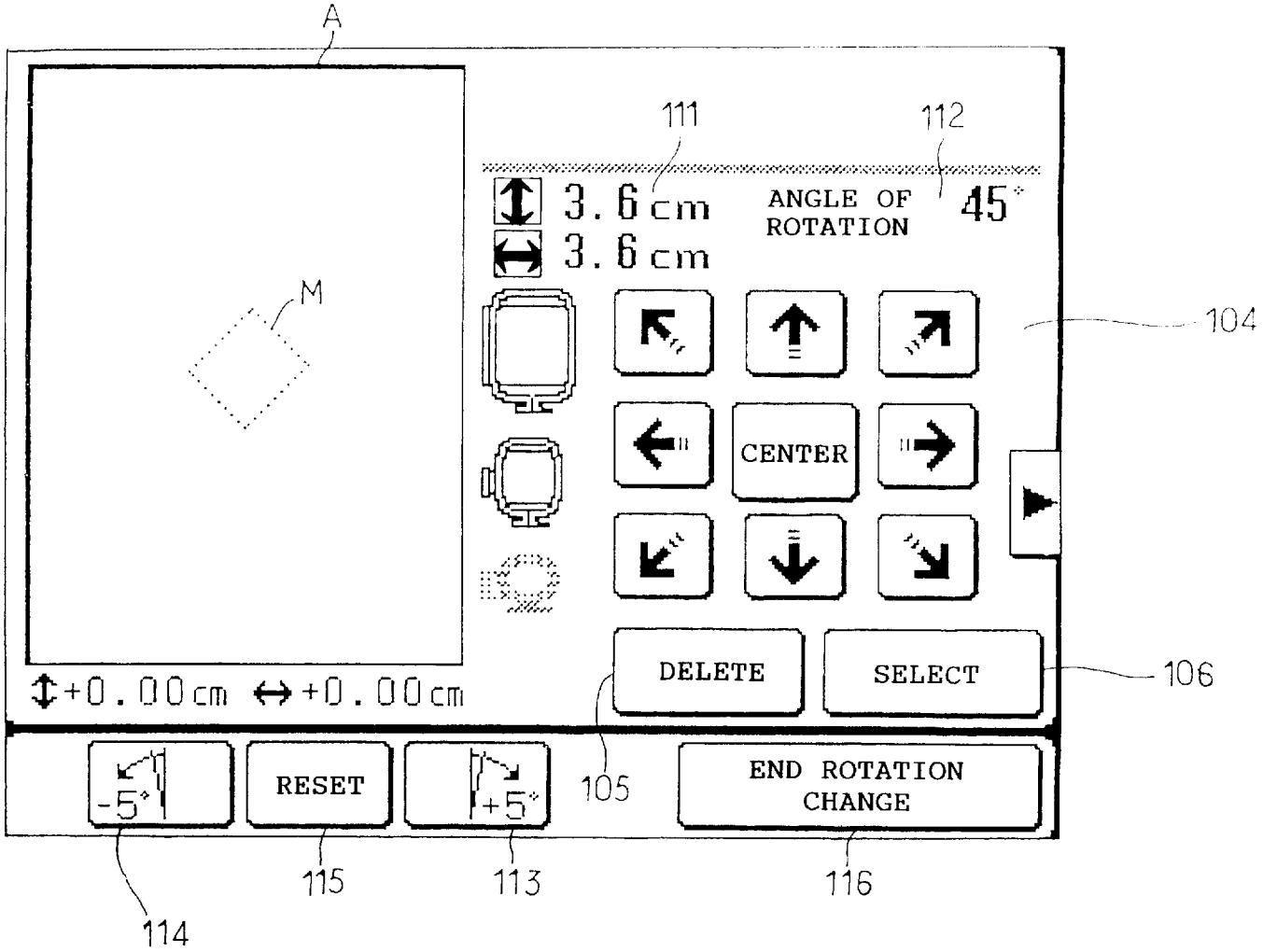
FIG. 9 shows an example of an arrangement and editing screen displayed on the LCD.

When the rotating key 107 is operated (YES at step S11), as shown by FIG. 9, a key display concerning rotation is displayed at a lower portion of the screen and rotating processing is called (step S12). The key display concerning rotation comprises a right turn key 113, a left turn key 114, a reset key 115 and a finish key 116. The right turn key 113 is a key for instructing rotation in the clockwise direction of the pattern and the left turn key 114 is a key for instructing rotation in the counterclockwise direction of the pattern. According to the embodiment, each time the right turn key 113 or the left turn key 114 is touched, the pattern is rotated by 5 degree in a corresponding direction with the center of the pattern as a rotational center. Further, the reset key 115 returns the rotated pattern to a state before rotation. The finish key 116 is a key for finally setting the instructed rotational angle and finishing the rotating processing.

When the rotating processing is called, as shown by FIG. 2, at step S20, it is first determined whether the right turn key 113 is touched. When the right turn key 113 is touched (YES at step S20), the rotational angle θ is increased from the current rotational angle by 5 degrees and is displayed at the angle display 112 (step S21). In this case, when the value of the rotational angle θ exceeds 360 degrees, the angle is again displayed in 5 degree increments starting at 5 degrees for the first position past 360 degrees.

In the meantime, when the left turn key 114 is touched (NO at step S20, YES at step S22), the rotational angle θ which is reduced from a current rotational angle by 5 degrees is displayed in the angle display 112 (step S23). At this occasion, when the value of the rotational angle θ is less than 0 degree, the value of the increment (5°) is subtracted the current value and an angle less than 360 degrees is displayed as the rotational angle θ.

At step S24, mask data is rotationally converted based on the designated rotational angle θ and the display of the mask M is changed based on the converted mask data. For example, FIG. 9 shows the display of the mask M when the rotational angle θ is changed to 45 degrees. Further, the operator can instruct a change in the rotational angle θ to a desired angle by repeatedly touching the right turn key 113 or the left turn key 114.

Further, when a desired rotational angle θ is achieved, the rotational angle θ is finally determined by touching the finish key 116 (YES at step S25). As a result, embroidery data of the pattern E is rotationally converted based on the instructed rotational angle θ and mask data is newly formed based on the embroidery data after the conversion (step S26). That is, the rotational conversion is carried out for the coordinate data of the embroidery data. Successively, mask data comprising minimum values of X and Y coordinates and maximum values of X and Y coordinates are calculated by using all of the converted coordinate data.

Whether the rotational converted pattern is confined in the layout region A, that is, the sewing area is determined based on the newly formed mask data (step S27). Specifically, it is determined that the pattern is not confined to the layout region A in any case where minimum value of X coordinate<0, a case of maximum value of X coordinate>X-direction length of layout region A, minimum value of Y coordinate<0, and a maximum value of Y coordinate>Y-direction length of layout region A. Further, also when the pattern is moved by operating the moving key 104, by carrying out the same determining processing in respect to the coordinate data after movement, whether a pattern after the movement is confined in the layout region A may be determined.

Figure 10:
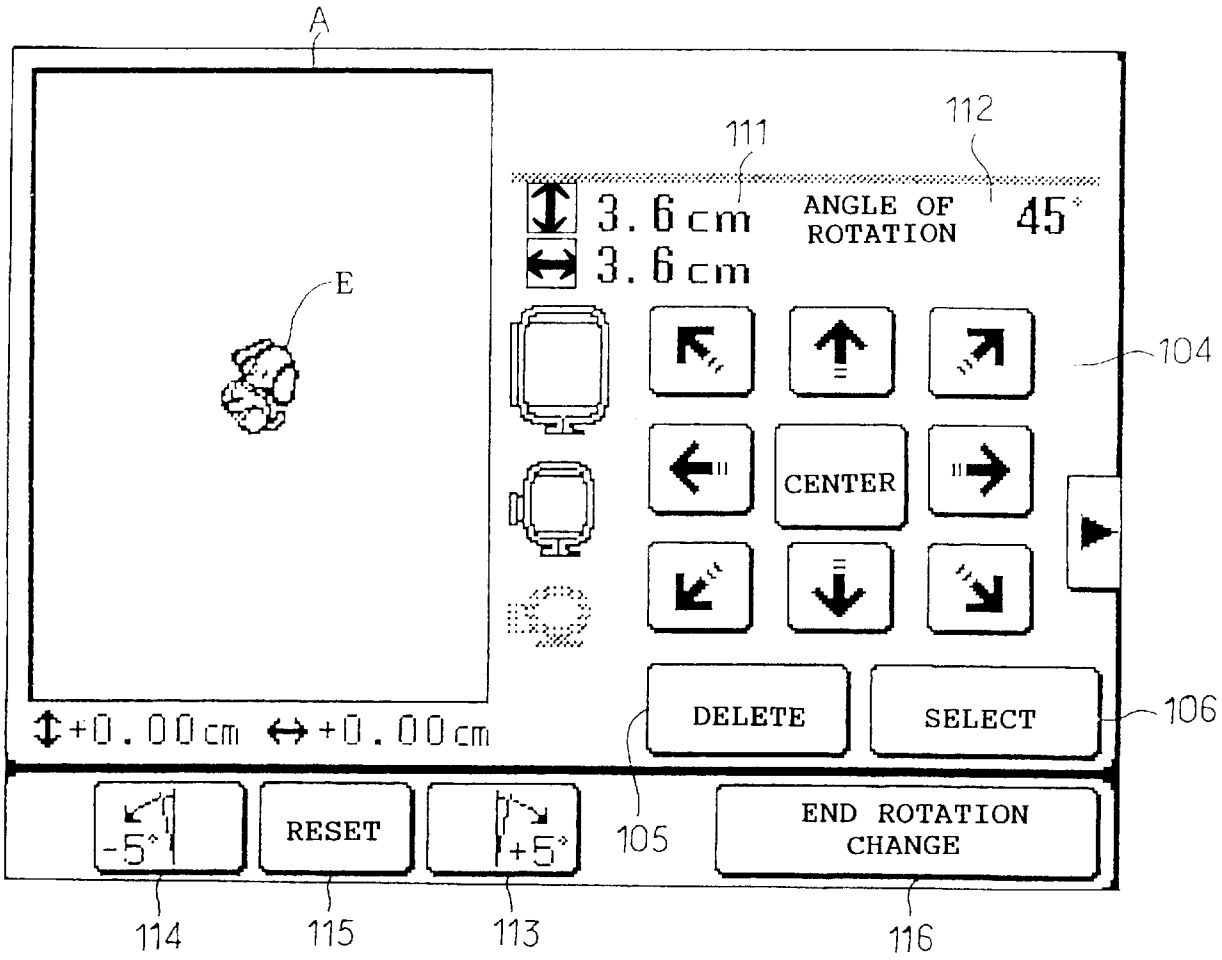
FIG. 10 shows an example of an arrangement and editing screen displayed on the LCD.
Figure 12:
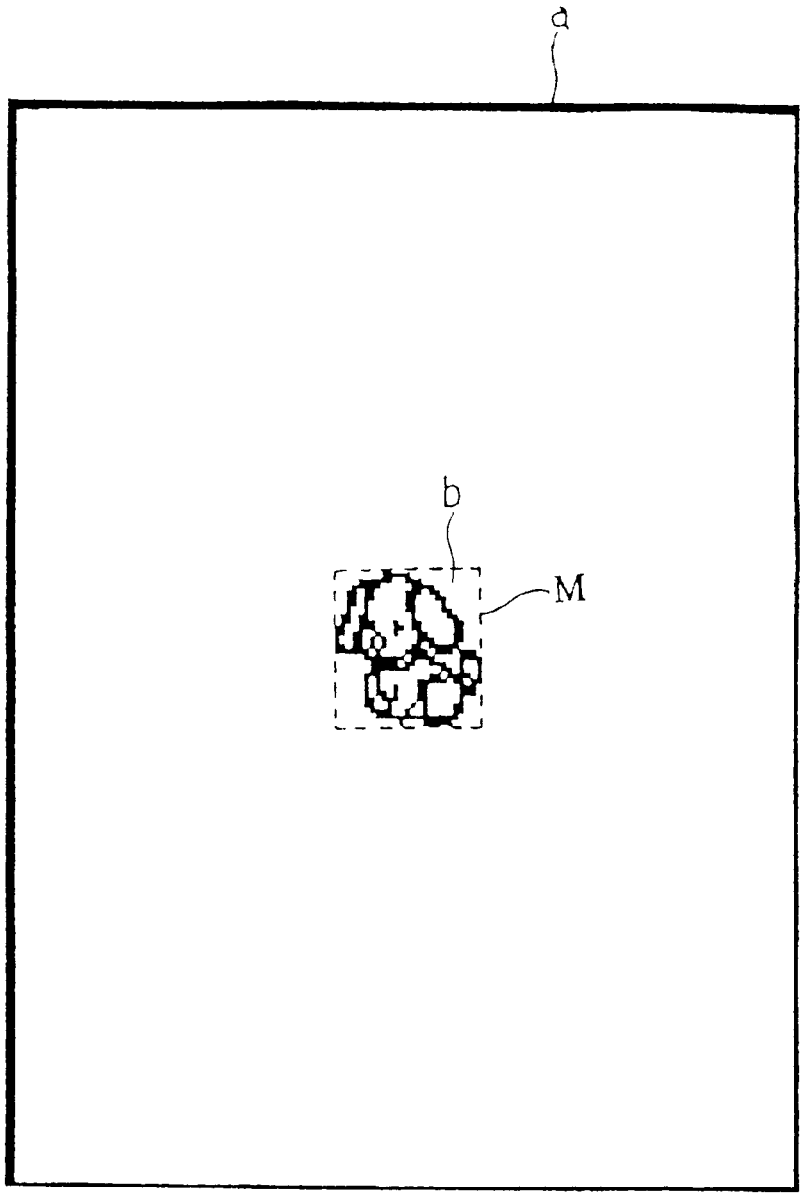
Fig.12 PRIOR ART
FIG. 12 is a view for explaining a conventional device.
Figure 13:
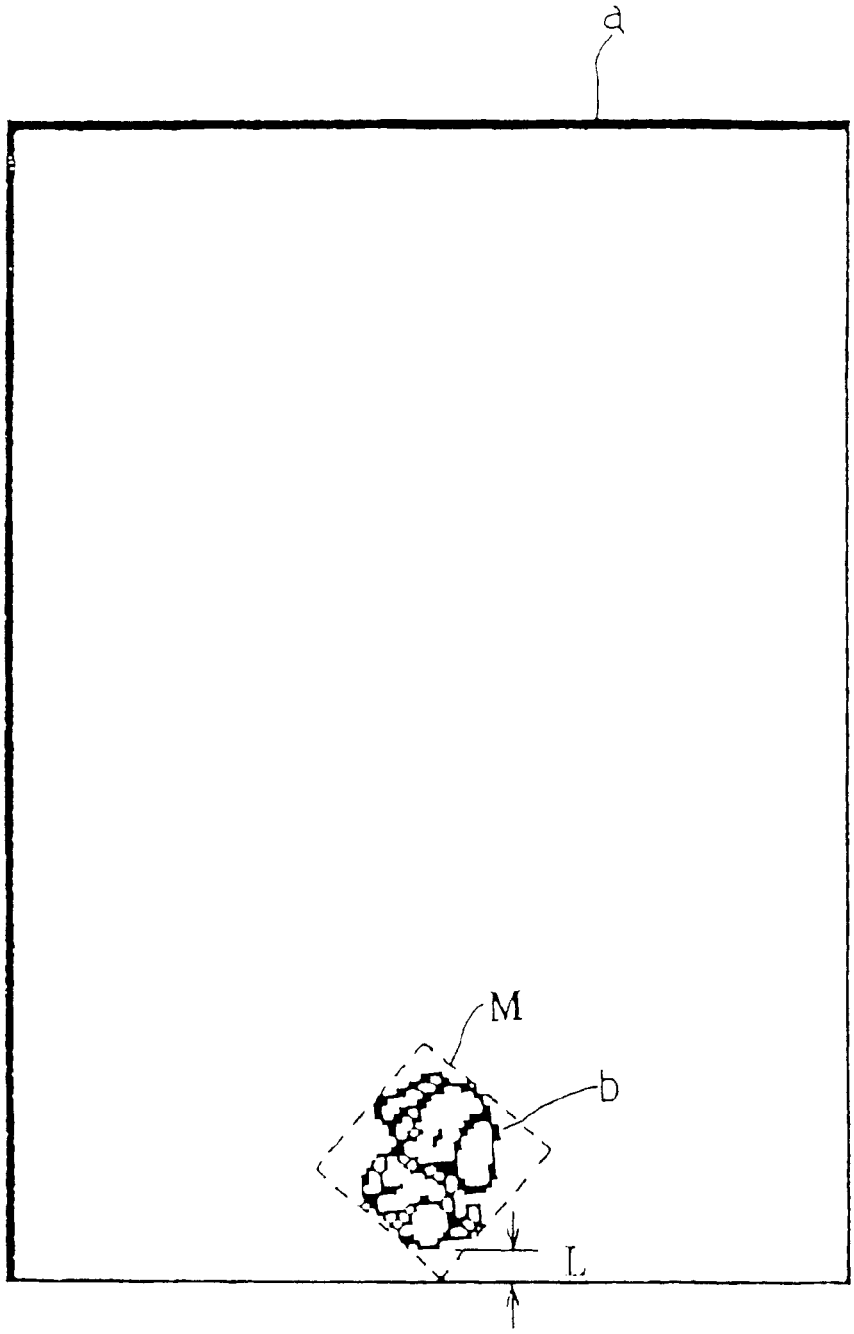
Fig.13 PRIOR ART
FIG. 13 is a view for explaining the conventional device.

When the pattern is not confined within the layout region A (NO at step S27), display of the mask M returns to the state before the rotational change and the operation returns to step S20. Further, in this case, a message stating that the pattern is not confined within the layout region A may be displayed on LCD 18. When the pattern is confined within the layout region A (YES at step S27), the embroidery data after the conversion and newly formed mask data are stored in RAM 25. Further, display data is formed based on the embroidery data after the conversion and based on the display data, for example, as shown by FIG. 10, the pattern E the rotational angle of which has been changed is displayed in the layout region A (step S28).

Thereafter, when the finish key 116 is touched, the rotating processing is finished and the operation returns to the main routine.

According to the above-described processing, even when the embroidery pattern is rotated, the mask data is formed newly based on the embroidery data which has been rotationally converted. Accordingly, an erroneous determination that the embroidery data after the rotation is confined within the sewing area, when the embroidery pattern is not confined therein is precluded.

Further, according to the embodiment, when rotation of an embroidery pattern is instructed and a rotational angle thereof is finally determined, embroidery data is rotationally converted and mask data is formed based on the converted embroidery data. That is, unnecessary mask data is not formed and accordingly, the efficiency is excellent.

FIG. 11 shows a second embodiment of the invention and an explanation will be given of the points differing from the first embodiment. Further, portions the same as those in the first embodiment are identified by the same reference numbers. The feature of the second embodiment is that instead of forming mask data based on rotational conversion, ROM 24 or the outside ROM card 16 stores mask data in correspondence with all possible rotated patterns provided by rotating an embroidery pattern by every 5 degrees.

Specifically, as shown by FIG. 11, ROM 24 is respectively stored with embroidery data and mask data for N embroidery patterns. The mask data is stored as mask M representing all sizes in the X and Y directions of patterns (hereinafter, rotated pattern) provided as a result of rotating the respective embroidery patterns by 0 degree, 5 degrees, . . . 355 degrees. In this case, the display data is formed by the embroidery data. Further, although not illustrated, the same data structure and processing applies to the outside ROM card 16.

According to the above-described structure, when the processing of rotationally converting an embroidery pattern is carried out, mask data in correspondence with an instructed angle is called and whether the embroidery pattern after rotation is confined in the layout region A is determined based on the mask data. Accordingly, time and labor for forming the mask data based on the embroidery data after the rotational conversion can be dispensed with.

Further, the invention is not limited to the above-described embodiments but can be modified as follows.

When the right turn key 113 or the left turn key 114 is touched, an embroidery pattern is rotated by 5 degrees, however, the invention is not limited to 5 degrees. That is, a unit degree by which rotation is instructed by one operation of the right turn key 113 or the left turn key 114 may be any number of degrees or parts of degrees (i.e., minutes and seconds). Further, the direction of rotation of a pattern may be either a clockwise direction or a counterclockwise direction.

Further, according to the rotating processing of an embroidery pattern, when the finish key 116 is touched and a rotational angle is finally determined, embroidery data is rotationally converted and mask data is formed based on the embroidery data after the conversion. However, at every touch of the right turn key 113 or the left turn key 114, the embroidery data may be rotationally converted and the mask data may be formed based on the embroidery data after the conversion.

Further, the finish key 116 may be omitted. That is, there may be a structure in which when the right turn key 113 or the left turn key 114 is touched, the rotation is instructed and the instructed rotational angle is finally determined.

Further, there may be a structure in which when an embroidery pattern is selected, mask data in correspondence with all of the rotated patterns provided by rotating the embroidery pattern by every unit angle is formed and stored in RAM 25.

Although according to the embodiment, the display data is formed based on embroidery data after conversion, display data stored in the ROM may be rotationally converted based on a rotational angle.

Further, although according to the above-described embodiment, an explanation has been given of an example of the sewing machine having the function as the embroidery data processing device, the invention is applicable also to an exclusive embroidery data processing device that is separate from a sewing machine.

Further, the invention can be performed as an embroidery data processing device by using a general personal computer system to read and execute the embroidery data processing program.

In this case, although a detailed explanation will be omitted, embroidery data processing programs may be provided by being stored in a recording medium such as a semiconductor memory, CD-ROM, CD-R, MO, MD, PD, DVD, floppy disk, magnetic tape or other magnetic or optical recording medium. The embroidery data processing programs may be read from an outside information processing device by using a cable or a wireless network and may be operated on the control device 20.

What is claimed is:

1. An embroidery data processing device for editing embroidery data, the embroidery data being used by a sewing machine having a sewing area having a predetermined size in a rightward/leftward (X) direction and a backward/forward (Y) direction, the embroidery data processing device comprising:

selecting means for selecting at least one embroidery pattern;

a display that displays the embroidery pattern selected by the selecting means within a layout region indicating the sewing area of the sewing machine, the embroidery pattern being arranged freely in the layout region;

rotation instructing means for instructing rotation of the embroidery pattern selected by the selecting means;

converting means for rotationally converting embroidery data of the selected embroidery pattern based on an instruction of the rotation instructing means;

mask data forming means for forming mask data indicating a length of the embroidery pattern in the X direction and a length of the embroidery pattern in the Y direction;

determining means for determining whether the embroidery pattern can be arranged within the layout region by using the mask data of the selected embroidery pattern; and regulating means for regulating the arrangement of the embroidery pattern if the determining means determines that the embroidery pattern can not be arranged within the layout region.

2. The embroidery data processing device according to claim 1, wherein every time after the converting means rotationally converts the embroidery data, the mask data forming means forms the mask data of the embroidery data converted by the converting means.

3. The embroidery data processing device according to claim 2, wherein the rotation instructing means instructs rotation of the embroidery data by a predetermined unit angle for each instruction, and the converting means rotationally converts the embroidery data at each instruction of the rotation instructing means.

4. The embroidery data processing device according to claim 2, further comprising:

angle setting means for setting a rotational angle for instruction by the rotation instructing means, wherein the converting means rotationally converts the embroidery data after the rotational angle has been set by the angle setting means.

5. The embroidery data processing device according to claim 1, wherein when the selecting means selects the embroidery pattern, the mask data is respectively formed for all of the embroidery data for all possible rotation angles instructed by the rotation instructing means.

6. An embroidery data processing device according to claim 1, further comprising:

display data forming means for forming display data based on the embroidery data converted by the converting means.

7. An embroidery data processing device according to claim 1, further comprising:

mask size displaying means for displaying the mask data of the embroidery pattern selected by the selecting means.

8. An embroidery data processing device for editing embroidery data, the embroidery data being used by a sewing machine having a sewing area having a predetermined size in a rightward/leftward (X) direction and a backward/forward (Y) direction, the embroidery data processing device comprising:

selecting means for selecting at least one embroidery pattern;

a display that displays the embroidery pattern selected by the selecting means within a layout region indicating the sewing area of the sewing machine, the embroidery pattern being arranged freely in the layout region;

rotation instructing means for instructing rotation of the embroidery pattern selected by the selecting means by a predetermined unit angle;

mask data storing means for storing mask data indicating a length of the embroidery pattern in the X direction and a length of the embroidery pattern in the Y direction, the mask data storing means storing the mask data in correspondence with all of rotated patterns by rotating the embroidery pattern by the predetermined unit angle;

converting means for rotationally converting embroidery data of the selected embroidery pattern based on an instruction of the rotation instructing means;

determining means for determining whether the embroidery pattern can be arranged within the layout region by using the mask data of the selected embroidery pattern; and regulating means for regulating the arrangement of the embroidery pattern if the determining means determines that the embroidery pattern can not be arranged within the layout region.

9. A computer readable storage medium for storing a computer program providing a method for editing embroidery data, the embroidery data being used by a sewing machine having a sewing area having a predetermined size in a rightward/leftward (X) direction and a backward/forward (Y) direction, the method comprising the steps of:

selecting at least one embroidery pattern;

displaying the selected embroidery pattern within a layout region indicating the sewing area of the sewing machine, the embroidery pattern being arranged freely in the layout region;

instructing rotation of the selected embroidery pattern;

rotationally converting embroidery data of the selected embroidery pattern;

forming mask data indicating a length of the embroidery pattern in the X direction and a length of the embroidery pattern in the Y direction;

determining whether the embroidery pattern can be arranged within the layout region by using the mask data of the selected embroidery pattern; and regulating the arrangement of the embroidery pattern if it is determined that the embroidery pattern can not be arranged within the layout region.

10. The computer readable storage medium according to claim 9, wherein every time after the computer program converts the embroidery data, the computer program forms the mask data of the embroidery data converted by the converting means.

11. The computer readable storage medium according to claim 10, wherein the computer program instructs rotation of the embroidery data by a predetermined unit angle every operation, and the computer program rotationally converts the embroidery data when rotation is instructed.

12. The computer readable storage medium according to claim 10, further comprising the step of setting a rotational angle, wherein the computer program rotationally converts the embroidery data after the rotational angle has been set.

13. The computer readable storage medium according to claim 9, wherein when selecting the embroidery pattern, the mask data is respectively formed for all of the embroidery data for all possible rotation angles capable of being instructed.

14. The computer readable storage medium according to claim 9, further comprising the step of forming display data based on the converted embroidery data.

15. The computer readable storage medium according to claim 9, further comprising the step of displaying the mask data of the selected embroidery pattern.

16. A method of setting an embroidery pattern at an angle to normal presentation of the pattern, comprising the steps of:

selecting a pattern;

rotating the pattern in a clockwise or counterclockwise direction in predetermined angular increments;

determining maximum and minimum X and Y coordinates of the pattern after rotation to establish a pattern mask;

moving the pattern to a different position relative to an initial position; and checking to determine whether the pattern as moved and rotated fits within a possible sewing area using the pattern mask.

17. The method according to claim 16, further comprising a step of setting the predetermined angular increment.

18. The method according to claim 16, wherein mask data is predetermined for every possible rotation position based on the predetermined angular increment.

19. The method according to claim 16, wherein the predetermined angular increment is 5°.

20. The method according to claim 16, wherein the determining step is executed after one of each instructed angular rotation and after completion of all instructed angular rotations.

* * * * *